United States Patent [19]

Sommer et al.

[11] Patent Number: 4,887,547

[45] Date of Patent: Dec. 19, 1989

[54] APPARATUS FOR CONTINUOUSLY APPLYING A UNIFORM COATING TO A MATERIAL WEB

[75] Inventors: Herbert Sommer, Düsseldorf; Hans Rückert, Ratingen, both of Fed. Rep. of Germany

[73] Assignee: Jagenberg Aktiengesellschaft, Dusseldorf, Fed. Rep. of Germany

[21] Appl. No.: 183,322

[22] Filed: Apr. 6, 1988

Related U.S. Application Data

[63] Continuation of Ser. No. 893,068, Aug. 1, 1986, abandoned.

[30] Foreign Application Priority Data

Jul. 31, 1985 [DE] Fed. Rep. of Germany ..... 3527379

[51] Int. Cl.[4] ..... B05C 3/02

[52] U.S. Cl. ..... 118/410; 118/413

[58] Field of Search ..... 427/356; 118/410, 413, 118/414

[56] References Cited

U.S. PATENT DOCUMENTS

| | | | |
|---|---|---|---|
| 3,474,757 | 10/1969 | Dreher | 118/414 X |
| 3,486,482 | 12/1969 | Hunger | 118/126 X |
| 3,533,833 | 10/1970 | Takahashi et al. | 118/410 X |
| 4,396,648 | 8/1983 | Holt et al. | 118/413 X |

FOREIGN PATENT DOCUMENTS

| | | | |
|---|---|---|---|
| 51698 | 5/1982 | European Pat. Off. | 118/410 |
| 2931800 | 2/1981 | Fed. Rep. of Germany . | |
| 1036839 | 7/1966 | United Kingdom | 118/410 |

*Primary Examiner*—Shrive Beck
*Assistant Examiner*—Alain Bashore
*Attorney, Agent, or Firm*—Sprung Horn Kramer & Woods

[57] ABSTRACT

The invention relates to a method and an apparatus for continuously applying a uniform coating to a material web (5), in particular a paper or cardboard web, travelling over a back roller (6), to which the coating material is applied at low pressure by means of a coating roller (2) and with guidance by a guide plate (8) into the coating gap (7) formed by the back roller and the coating roller, whereupon the coating material is metered by a metering member (15) and in the region of a layer close to the material web is partly drained in order to form a barrier layer and final metering takes place in a final metering device (23) by means of a final metering member (24) with low contact pressure. Due to a three-stage method of this type and the apparatus suitable therefore, even at comparatively high material web speeds, constant good coating qualities can even be achieved with extremely low coating weights.

7 Claims, 3 Drawing Sheets

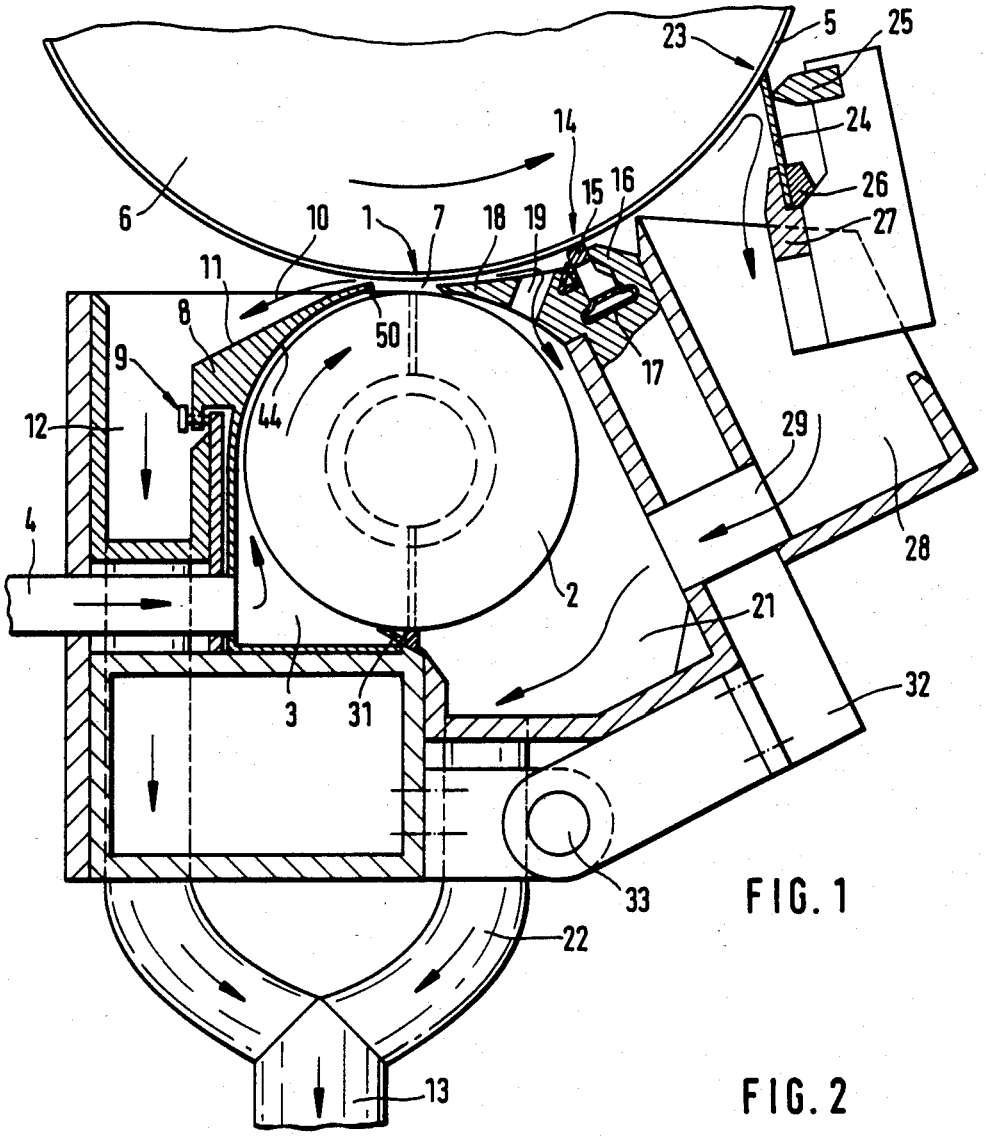
FIG. 1
FIG. 2
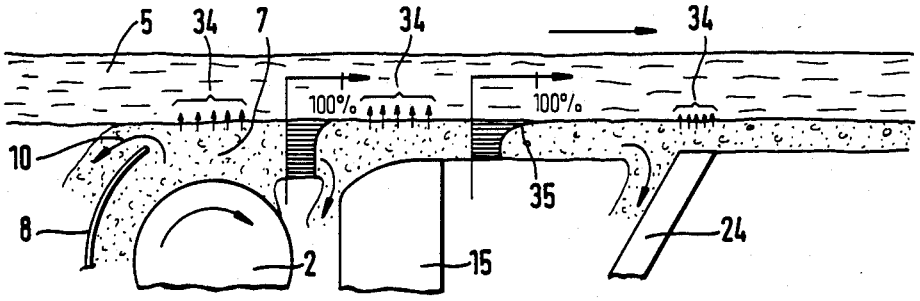

APPARATUS FOR CONTINUOUSLY APPLYING A UNIFORM COATING TO A MATERIAL WEB

This application is a continuation of application Ser. No. 893,068, filed 8/1/86, now abandoned.

The invention relates to a method and an apparatus for continuously applying a uniform coating to a material web, in particular a paper or cardboard web, travelling over a back roller, to which the coating material is first of all applied in excess by means of a coating roller and then the excess is scraped off.

When coating travelling material webs, in particular paper or cardboard webs, there is an increasing desire for higher material web speeds, processing high solid matter concentrations of the coating material, in order to be able to save drying energy and possibly at the same time achieving the lowest coating weights. The material web speeds are currently normally in the order of approximately 1300–1400 meters per minute. Mass printing papers, such as so called LWC (dry coating weight of 4–8 g/m$^2$) are primarily coated at such speeds.

On account of the current conventional coating and metering methods, the above speed cannot be exceeded substantially, without appreciably reducing the solid particle content of the coating material in order to maintain the desired coating weight.

Belonging to the known coating and metering methods are on the one hand flooded-nip-coaters and on the other hand so-called short-dwell-coaters.

A flooded-nip-coater is known for example from German OS 29 31 800. In this method the coating material is applied in excess by means of a coating roller to the paper web and equalised and metered by a metering member, which in the case of low coating weights is generally constructed as a rigid blade. The excess may in this case be regulated by way of the width of the coating gap located between the coating roller and the back roller and the peripheral speed of the coating roller. The liquid pressure occurring in the coating gap leads to drainage of a layer of the coating material facing the paper web, due to which a blocking or filter layer is formed, which prevents constituents of the coating material from being driven too considerably into the paper web at the time of metering. At relatively low web speeds, the liquid pressure in the coating gap can be controlled by way of the gap width and the speed. At high web speeds, the coating gap must be adjusted to be very narrow, since otherwise turbulence occuring in the roll gap would lead to uncoated points on the material web. However when the gap is kept narrow, the hydrodynamic pressure increases out of proportion and the first of all positive effect of partial drainage changes to the opposite with the result that the coating material is pressed into and through the material web.

Moreover the film-splitting effect occuring in the diverging part of the coating gap increases, which leads to a highly irregular excess film.

The short-dwell method also known for coating material webs is disclosed by European Patent Application 51 698. In this case the coating material is supplied under pressure into a chamber, which is defined on the outlet side of the material web by the metering member, on the inlet side of the material web by an overflow plate located at a limited distance from the material web and on the end face by sealing members. Depending on the operating conditions, 5–30 times the coating quantity flows over the overflow plate. Owing to the fact that the coating roller is dispensed with, this is a compact coating unit, with by which, with good coordination of the paper web and of the coating material, machine speeds of up to approximately 600–700 meters per minute, with the same boundary conditions, under certain circumstances somewhat lower coating weights can be applied than witha flooded-nip-coater, because at relatively low speeds, the hydrodynamic pressure at the metering member is also relatively low and therefore a blocking layer does not need to be provided before the metering member in each case. At the aforementioned speeds, the overflow of the coating material is also relatively calm and uniform, so that as a rule complete wetting of the material web is ensured.

However, at high web speeds, the liquid pressure at the metering member increases out of proportion and owing to the absence of a blocking layer, the coating material is pressed into or through the material web.

Furthermore, the pulse of the liquid boundary layer formed on the material web increases so considerably that the metering member, which is generally constructed as a rigid blade, no longer withstands this pressure particularly with a high solid matter content of the coating material. The coating weight therefore increases considerably. Thus, with the same boundary conditions, the coating weight of a flooded-nip-coater is generally less than that of a short-dwell-coater at speeds greater than 700 meters per minute. Moreover, due to the overflow plate, a drawback occurs in high speed short-dwell-coaters insofar that the coating material sprays out in an uncontrolled manner at the overflow gap, since the air boundary layer penetrating the coating area with the material web may penetrate partly as far as the metering member, which moreover leads to uncoated points in the coating application.

It is the object of the invention to propose a method by means of which, with comparatively high material web speeds, uniform satisfactory quality can be achieved, if necessary even with extremely low coating weights of the coating. Moreover it is the object of the invention to provide an apparatus in which the good coating quality is achieved in a suprisingly simple manner, even at high machine speeds, due to intentionally selected and cooperating units.

This object is achieved by the method according to the invention and the apparatus according to the invention for carrying out the method according to the claims.

The method for applying the coating material to a travelling material web provides considerable advantages. Due to the pre-metered guidance of the coating material into the coating gap between the coating roller and the back roller, the hydrodynamic pressure building up therein can be varied within wide limits by adjusting the roll gap, preferably it can be minimised as the roll gap becomes larger. The coating material is conveyed more uniformly, i.e. without air inclusions and in a larger quantity into the coating gap, so that the latter may be adjusted to be larger than in conventional flooded-nip-coaters, so that with a low hydrodynamic pressure, low turbulance occurs and thus the danger of uncoated points is less.

With a low contact pressure of the pre-metering device, a value of 0–20% of the contact force (linear pressure) is to be understood in the region of the final metering, in which case 0% means that a metering member used for metering is adjusted to a fixed gap of 0.01 to 0.1 mm, and indeed depending on the speed, coating material etc. Due to the metering of the coating material, it is ensured that for final metering, exactly so much excess is entrained as is required for adequate flushing at this point, in which case it is important that during the metering operation, partial drainage of a thin boundary layer of the coating material cose to the material web takes place, in which the solid components (pigments and binders) of the coating material are largely immobilised. The layer forming in this way then acts as a barrier layer during final metering and prevents the penetration of solid constituents of the coating material into the paper web.

With the apparatus proposed for carrying out the method, in which only a pre-metered quantity of the coating material is conveyed into the coating gap, it is ensured that even at high machine speeds, an exactly defined barrier layer is produced in a metered coating material on the material web, which prevents the liquid pressure at the final metering member from driving the coating material too considerably into the material web. Moreover, due to the guide plate, the coating material is distributed absolutely uniformly both in the direction of travel of the material web as well as a right angles there to an it penetrates the coating gap free from air bubbles. For this purpose, in an appropriate embodiment of the invention, it is provided that the guide plate is curved to correspond to the periphery of the coating roller at least in the region facing the coating gap between the coating roller and the back roller. This provides exact guidance of the coating material, particularly when the guide plate is constructed to be adjustable as regards its spacing from the periphery of the coating roller. In this way, the hydrodynamic pressure building up in the coating gap can be adjusted and also reproduced exactly. In particular the introduction of air bubbles into the coating gap is avoided, thus achieving particularly uniform coating, free from uncoated points.

For equalising pressure fluctuations, which emanate for example from the supplier of the coating material, a slot-like passage is advantageously provided between the guide plate and the liquid chamber, through which slot excess coating material, which is not conveyed by the coating roller into the coating gap, may flow.

A guide member provided with overflow openings is provided for further guidance of the coating material, between the coating gap and the metering member, which guide member is adapted on its lower and upper side substantially to the peripheral region of the coating roller and the back roller, at a distance therefrom or in abutment therewith.

In order to achieve partial drainage or a barrier layer in the coating material, it is question of the geometric construction of the metering member. Appropriately the metering member is constructed as a doctor-blade and on its end face facing the material web is provided with a converging, preferably convex converging shape in the direction of the final metering member and with repect to the material web.

The final metering member is preferably constructed as a rigid blade.

In order that the apparatus is easily accessible at the three different units, the final metering member as well as its retaining members and a collecting trough located therebelow as well as the metering member and its retaining members with an associated collecting chamber are located on a frame which is able to swing about a substantially horizontal axis. By tilting the entire apparatus down, easy access is thus guaranteed at the time of cleaning, repairs and exchange of individual unit components. In addition the guide plate may also be swung down separately in order to release the coating roller.

Two preferred embodiments of the invention are illustrated in the drawings and described in detail hereafter. The drawings show diagrammatically:

FIG. 1 shows a coating and metering device with coater, metering device and final metering device inside view;

FIG. 2 shows the operation at the time of coating a material web according to FIG. 1;

Figure 3:
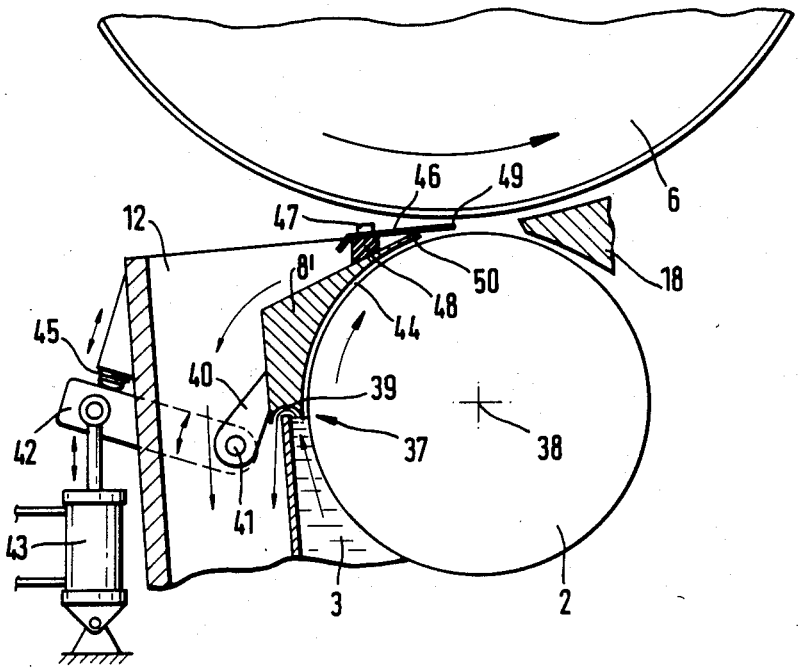
FIG. 3 shows a further embodiment of the preliminary metering device according to FIG. 1, likewise inside view.

The coating and preliminary metering device illustrated in FIG. 1 comprises a coater 1 with a rotating coating roller 2, which in known manner conveys coating material from a liquid chamber 3, which is connected to an inlet 4, into a coating gap 7 located between the coating roller 2 and a back roller 6 serving for supporting a material web 5.

The coating material is conveyed in a pre-metered manner between the peripheral surface of the coating roller 2 and a guide plate 8 and indeed into the region of the coating gap 7. The guide plate 8 may be shifted by way of an adjusting device 9 as regards its spacing 44 from the peripheral surface of the coating roller 2, so that the hydrodynamic pressure of the coating material building up in the coating gap 7 can be adjuted and reproduced.

On its upper side remote from the coating roller 2, the guide plate 8 comprises a drainage surface 11, over which excess coating material may flow in the direction of arrow 10 from the coating gap 7 into a return pipe 12 and from there into a collecting pipe 13. From there the coating material returns to a collecting container which is not shown, from where it is again conveyed to the inlet 4.

In the present case the coating roller 2 and the back roller 6 rotate in opposite directions. Seen in the direction of movement of the material web 5, a metering device 14 is located behind the coating gap 7. This metering device 14 comprises a metering member 15 constructed as a doctor-blade, which is guided in a support member 16 serving as a retaining member and is supported by way of a pressure hose 17. The metering member 15 is adjustable with respect to the material web 5 due to appropriate actuation of the pressure hose 17.

A guide member 18 tapering in the form of a wedge is provided between the metering device 14 and the coating gap 7, which guide member likewise serves for guiding the coating material and is provided with overflow openings 19, through which coating material scraped off by the metering member 15 returns to a collecting chamber 21 and flows from there to the collecting pipe 13 likewise by way of a return pipe 22. For the desired guidance and conveyance of the coating material, the upper and lower sides of the guide member 18 are adapted to the periphery of the coating roller 2 and the back roller 6 at a distance apart or are held in abutment with respect to the coating roller 2.

A final metering device 23 is located behind the metering device 14, seen in the direction of travel of the web. The final metering device comprises a rigid blade 24, whereof the retaining members are constructed as a support bar 25, clamping bar 26 and clamping member 27. Associated with the final metering device 23 is a collecting trough 28, which is connected by an opening 29 to the collecting chamber 21. The latter is sealed with respect to the liquid chamber 3 by a sealing flange 31. In the same way as the metering device 14 with the associated collecting chamber 21, the final metering device 23 with the associated collecting trough 28 is located on a frame 32, which is mounted to tilt about a substantially horizontal axis 33, so that the metering device 14 and the final metering device 23 may be tilted downwards and thus expose the coater 1 for repairs, cleaning or the like.

The method of operation of the coating and metering device at high web speeds will be described in detail with reference to FIG. 2.

Coating material is conveyed into the coating gap 7 by way of the coating roller 2 and with the assistance of the guide plate 8, so that the material web 5 consisting of paper or cardboard is coated with coating material on its side facing the coating roller 2. Coating takes place with a very low liquid pressure, so that the penetration of the aqueous constituents of the coating material is low, as indicated by the reference number 34. Since the coating material has been applied in excess, the excess coating material travels back according to arrow 10 over the upper side of the guide plate 8 into the collecting container.

The metering member 15 comprises a convex end face which converges with respect to the material web 5. The adjustable metering member 15 operates at low force with respect to the specific surface force in the contact zone, so that uniform distribution of the coating material is achieved both in the direction of travel of the material web 5 as well as at right angles thereto, with little penetration 34. Due to the geometric construction of the metering member 15, partial drainage of a thin boundary layer 34 on the material web 5 is achieved, in which the solid components, such as pigments and binders of the coating material are largely immobilised.

The result of this barrier layer 35 in the region of the final metering member 24 is that coating material is not driven too considerably into the material web 5. The excess which is minimised in quantity and equalised and reaches the final metering member 24 with low penetration 34 ensures that the contact forces necessary for final metering can be reduced to a minimum. This results in reduced wear of the final metering member 24 and/or a lower coating weight with higher web speeds or a higher solid matter content of the coating material.

Figure 4:
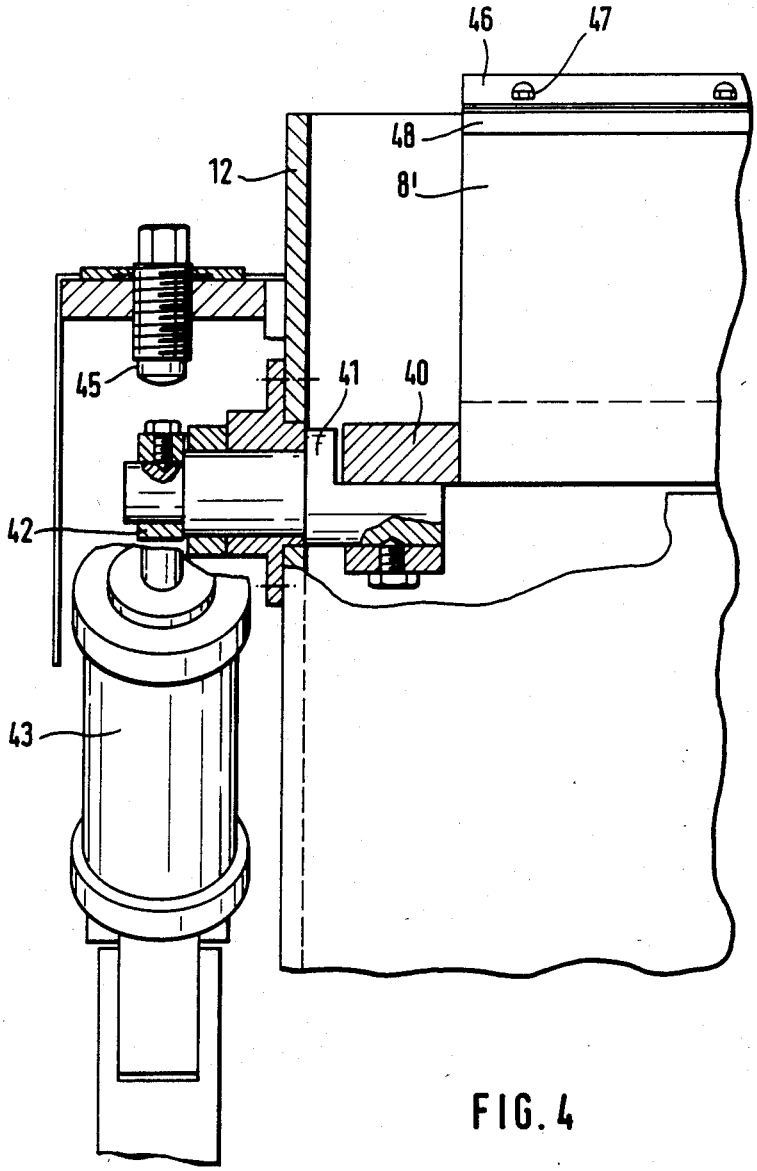
FIG. 4 is a front view of the preliminary metering device according to FIG. 3.

FIGS. 3 and 4 show a further embodiment of the guide plate 8 known from FIG. 1 and in this case designated by the reference number 8'. The other parts designated by the same reference numerals as FIG. 1 have the same function as in the associated description. In addition, the guide plate 8' is arranged separately with respect to the liquid chamber 3, in which case the parting line 37 forms a horizontal plane approximately with the axis 38 of the coating roller 2.

Provided between the guide plate 8' and the liquid trough 3 is a slot 30, which serves as the overflow for excess coating material, in order that a high preliminary metering accuracy is consequently achieved.

For the mounting of the guide plate 8' the latter is provided at its two ends within the drainage pipe 12 with fish-plates 40 which are connected to a bearing shaft 41.

This bearing shaft 41 is mounted to rotate in the wall of the drainage pipe 12 and pulled through the latter towards the outside and at each of its ends supports a rotary lever 42 which is connected in a non-rotary manner thereto. At their free ends, these levers 42 in turn comprise a working cylinder 43, in which case the guide plate 8' is tilted about the axis of the bearing shaft 41. For adjusting the conveying gap 44, an adjustable stop 45 is respectively provided outside the drainage pipe 12 on both sides of the drainage pipe 12, against which the levers 42 come to bear in the operating position of the guide plate 8'.

In order that the point 50 of the guide plate 8' projecting into the coating gap 7 can be adjusted even more finely, a spring plate 46 is provided, which is fastened by screws 47 and an elastic support 48 in the manner of a one-sided lever in the region of the point 50 of the guide plate 8'. By rotating the screws 47, the free end 49 of the spring plate 46 projecting into the coating gap 7 may be moved up and down in the tip 50 of the guide plate 8', which serves as a fulcrum, due to which the spacing 44 in the coating gap 7 can be additionally varied. This additional spring plate 46 is also provided for the guide plate 8 illustrated in FIG. 1.

The method of operation of the afore-described arrangement is as follows:

The coating material is pumped in excess into the liquid chamber 3, in which case a uniform level is consequently automatically adjusted by the slot 39, that the coating material not drawn up by the coating roller 2 flows into the drainage pipe 12 through the slot 39. In this case, the slot 39 must be so large that the coating material conveyed by the coating roller 2 can be conveyed virtually without pressure through the conveying gap 44, so that a controlled hydrodynamic pressure can be built up for the first time in the coating gap 7.

It will be understood that the invention is not limited to the embodiment illustrated, but that variations within the framework of the claims are possible. Thus the metering member 15 does not necessarily need to be constructed as a doctor-blade, rather it may be constructed as a bent blade and possibly also as roller doctor. Likewise, under certain circumstances and depending on the operating conditions, the final metering member 24 may be constructed as a doctor blade and if necessary also as a bent blade or roller doctor.

We claim:

1. In an apparatus for continuously applying a uniform coating of material to a web, comprising means for applying coating material including a back roller over which the web travels, a coating roller for the coating material drawing liquid from a liquid chamber and spaced apart from the back roller to form a coating gap, and means disposed downstream of the applying means and separate therefrom for metering the coating on the web, the improvement wherein the coating roller draws in liquid on one side and comprises a guide plate on said side extending into the coating gap between the coating roller and the back roller and wherein at least in a region facing the coating gap between the coating roller and the back roller, the guide plate is curved to correspond to the periphery of the coating roller.

2. The apparatus according to claim 1, further comprising means mounting the guide plate to be adjustable in its spacing from the periphery of the coating roller.

3. The apparatus according to claim 1, wherein the guide plate is a continuation of an upper edge of the liquid chamber to form a slot passage for excess coating material between the liquid chamber and a lower part of the guide plate.

4. The apparatus according to claim 1, further comprising a guide member behind the coating gap for receiving a metering member and having overflow openings and wherein the guide member has lower and upper sides adapted substantially to the peripheral region of the coating roller and of the back roller.

5. The apparatus according to claim 4, wherein the metering member operates at a low force level with regard to the specific surface force in a contact zone with the web, and is provided on an end face facing the web with geometry bringing about partial drainage in a thin boundary layer of the coating material close to the web.

6. The apparatus according to claim 5, wherein the metering member comprises a doctor-blade and on its end face facing the web, has a convex converging shape.

7. The apparatus according to claim 1, wherein the coating roller and backing roller rotate in the same direction that the web travels in.

* * * * *